United States Patent [19]

Stoltman

[11] 4,346,555

[45] Aug. 31, 1982

[54] EXHAUST AIR FLOW PROPORTIONING VALVE

[75] Inventor: Donald D. Stoltman, Henrietta, N.Y.

[73] Assignee: General Motors Corporation, Detroit, Mich.

[21] Appl. No.: 159,455

[22] Filed: Jun. 16, 1980

[51] Int. Cl.[3] ..... F01N 3/22

[52] U.S. Cl. ..... 60/290; 137/117

[58] Field of Search ..... 60/289, 290; 137/117

[56] References Cited

U.S. PATENT DOCUMENTS

| | | | |
|---|---|---|---|
| 2,556,829 | 6/1951 | Teague | 137/117 |
| 3,591,961 | 7/1971 | Woodward | 60/290 |
| 3,919,842 | 11/1975 | Bolton | 137/117 |
| 4,077,208 | 3/1978 | Sawada | 60/290 |
| 4,081,960 | 4/1978 | Haka | 60/289 |

FOREIGN PATENT DOCUMENTS

| | | | |
|---|---|---|---|
| 800951 | 9/1958 | United Kingdom | 137/117 |

*Primary Examiner*—Douglas Hart

*Attorney, Agent, or Firm*—C. K. Veenstra

[57] ABSTRACT

A valve controlling the rate of air flow from a supply pump to an engine exhaust system directs the air flow to the exhaust system through an orifice in a diaphragm valve which is associated with a valve seat separating the air supply from an excess air discharge port. The pressures acting on the diaphragm displace the diaphragm from the valve seat the amount necessary for the rate of air flow through the orifice to the exhaust system to be proportional to the rate of exhaust flow through the exhaust system and for the excess air flow supplied by the pump to be discharged through the excess air port.

1 Claim, 2 Drawing Figures

EXHAUST AIR FLOW PROPORTIONING VALVE

TECHNICAL FIELD

This invention relates to a valve for controlling air flow to an engine exhaust system.

BACKGROUND

In many applications air is supplied to the exhaust system of an automotive engine to support oxidation of undesirable exhaust gas constituents. In some such applications, it may be desirable to limit the rate of air flow to the exhaust system to a proportion of the rate of exhaust flow through the exhaust system. U.S. Pat. No. 3,919,842 issued Nov. 18, 1975 in the name of R. A. Bolton shows one example of a valve which limits the rate of air flow to a proportion of the rate of exhaust flow.

SUMMARY OF THE INVENTION

This invention provides a valve of simplified construction for proportioning the rate of air flow to an engine exhaust system to the rate of exhaust flow through the exhaust system.

In a valve according to this invention, air flow to the exhaust system passes through an orifice in a diaphragm valve so that the diaphragm directly senses both the supply pressure and the delivery pressure; the diaphragm valve accordingly is displaced from a valve seat the amount necessary for the air flow to the exhaust system to be proportional to the exhaust flow and for excess air flow to be discharged through an excess air port.

The details as well as other features and advantages of this invention are set forth in the remainder of the specification and are shown in the accompanying drawings.

BEST MODE FOR CARRYING OUT THE INVENTION

Figure 1:
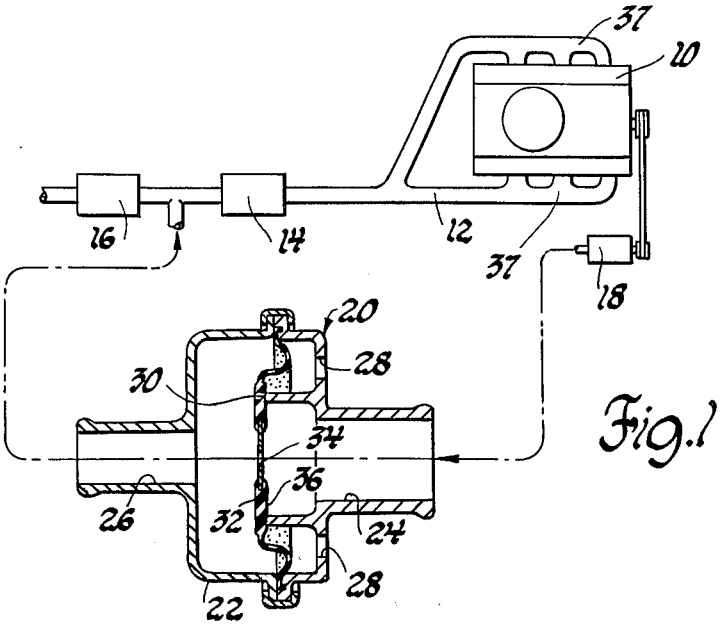
FIG. 1 is a schematic view of an engine having one embodiment of this exhaust air flow proportioning valve.

Referring first to FIG. 1, an internal combustion engine 10 has an exhaust system 12 including a pair of catalytic converter beds 14 and 16. An air pump 18 driven by engine 10 directs air to exhaust system 12 between converter beds 14 and 16. An exhaust air flow proportioning valve 20 controls air flow from pump 18 so that the rate of air flow to exhaust system 12 is proportional to the rate of exhaust flow through exhaust system 12.

Proportioning valve 20 has a multi-piece housing 22 with a supply port 24 receiving air from pump 18 and a delivery port 26 directing air to exhaust system 12. In addition, housing 22 has one or more excess air ports 28 for discharging excess air flow—in this particular embodiment, directly to the atmosphere. Housing 22 also includes a valve seat 30 surrounding supply port 24 and separating supply port 24 from excess air ports 28.

A diaphragm 32 is secured in housing 22 and separates delivery port 26 from supply port 24, excess air ports 28 and valve seat 30. Diaphragm 32 has an orifice 34 for air flow from supply port 24 to delivery port 26 and on to exhaust system 12.

The right hand face of diaphragm 32 has a valve surface 36 which surrounds orifice 34 and is associated with valve seat 30. The supply pressure in supply port 24 acts on the portion of diaphragm 32 surrounded by valve surface 36, in opposition to the delivery pressure in delivery port 26 which acts against the entire left hand face of diaphragm 32, and displaces diaphragm 32 leftwardly sufficiently to balance the forces on diaphragm 32. Thus a portion of the air flow from pump 18 passes through orifice 34 to delivery port 26 and on to exhaust system 12, and the remainder of the air flow from pump 18 passes between valve seat 30 and valve surface 36 and is discharged through excess air ports 28.

Air flow through orifice 34 to exhaust system 12 is represented by the following equation:

$$Fa \doteq Ao(Ps-Pd)^{\frac{1}{2}}$$

where Fa is the rate of air flow, Ao is the area of orifice 34, Ps is the gauge pressure in supply port 24, and Pd is the gauge pressure in delivery port 26.

Similarly, the rate of flow through converter bed 16 is expressed as follows:

$$Fa+Fe=Ae(Pd)^{\frac{1}{2}}$$

where Fe is the rate of flow of exhaust gases through exhaust system 12 and Ae represents the effective area of exhaust system 12 in and downstream of converter bed 16. It is noted that Pd, the delivery pressure in port 26, is substantially equal to the pressure in exhaust system 12 between converter beds 14 and 16.

Accordingly, the rate of air flow to exhaust system 12 as a proportion of the rate of flow through converter bed 16 may be represented by the following:

$$Fa/(Fa+Fe)=Ao(Ps-Pd)^{\frac{1}{2}}/Ae(Pd)^{\frac{1}{2}}$$

It was noted above that the supply pressure in port 24 displaced diaphragm 32 leftwardly until the forces on diaphragm 32 are balanced. At that time, $$PsAv=PdAd$$

where Av is the area of diaphragm 32 surrounded by valve surface 36 and Ad is the entire area of diaphragm 32. Thus the rate of air flow to exhaust system 12 as a proportion of the flow through converter bed 16 may be written as follows:

$$Fa/(Fa+Fe)=Ao(PdAd/Av-Pd)^{\frac{1}{2}}/Ae(Pd)^{\frac{1}{2}}$$

$$Fa/(Fa+Fe)=Ao(Ad/Av-1)^{\frac{1}{2}}/Ae$$

$$Fa/(Fa+Fe)=\text{constant}$$

Clearly, therefore, the rate of air flow to exhaust system 12 is proportional to the rate of exhaust flow through exhaust system 12.

It will be appreciated that valve 20 may be used to deliver air to other portions of exhaust system 12—such as exhaust manifolds 37—when air flow to such portions should be proportional to exhaust flow.

Figure 2:
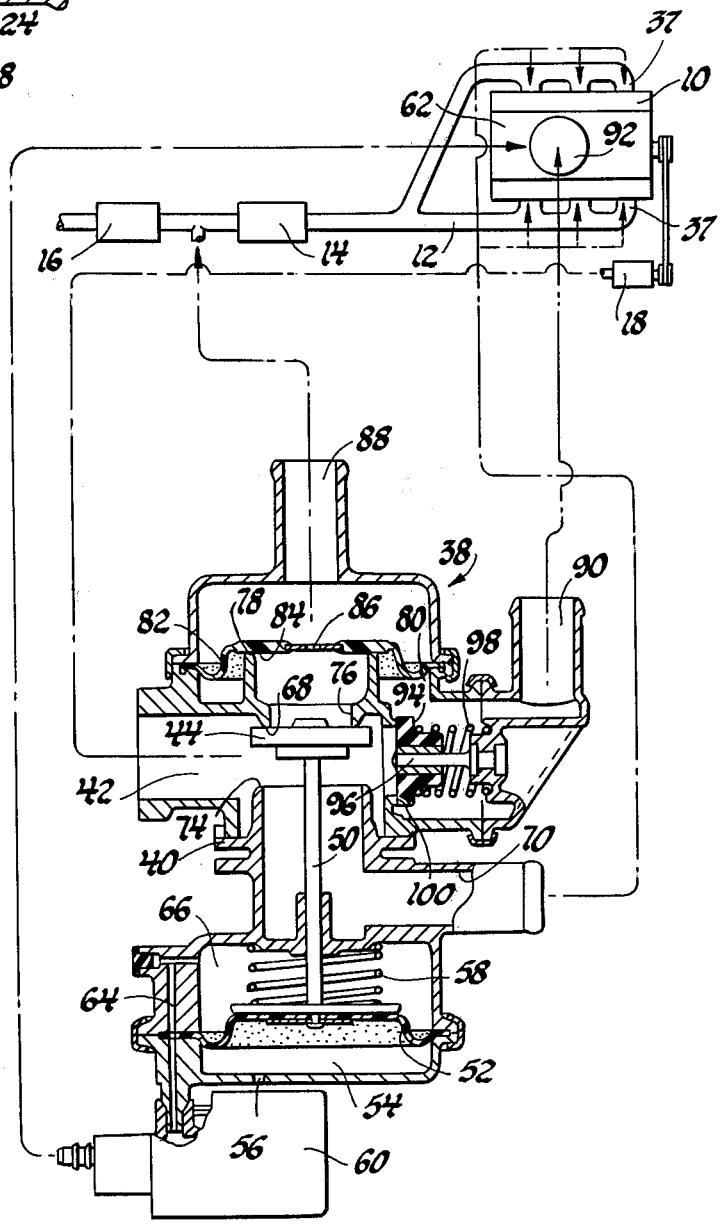
FIG. 2 is a schematic view of an engine having a multi-function air management valve incorporating one embodiment of this exhaust air flow proportioning valve.

FIG. 2 shows an air management valve 38 in which this exhaust air flow proportioning valve is integrated with other control elements. As shown in FIG. 2, pump 18 directs air to exhaust system 12 through air management valve 38. The multi-piece housing 40 of air management valve 38 has an inlet plenum 42. A valve disc 44, disposed in inlet plenum 42, is mounted on a stem 50 which is secured to a diaphragm 52. The chamber 54 below diaphragm 52 is vented to atmosphere through an aperture 56, and a spring 58 biases diaphragm 52 downwardly.

When energized, a solenoid valve 60 applies vacuum from the engine intake manifold 62 through a passage 64 to the chamber 66 above diaphragm 52. Diaphrgm 52 then lifts stem 50 against the bias of spring 58 to engage valve disc 44 with a valve seat 68. Air is then directed from inlet plenum 42 through an exhaust manifold supply port 70 to the engine exhaust manifolds 37. When solenoid valve 60 is deenergized, the manifold vacuum signal in chamber 66 is bled down and spring 58 moves diaphragm 52 downwardly, engaging valve disc 44 with a valve seat 74. Air is then directed from inlet plenum 42 through a converter supply port 76.

Converter supply port 76 is surrounded by a valve seat 78 which separates converter supply port 76 from an excess air port 80. The lower face of a diaphragm 82 has a valve surface 84 which is associated with valve seat 78 and surrounds an orifice 86. Air flows from supply port 76 through orifice 86 to a delivery port 88 and on to exhaust system 12 between converter beds 14 and 16. As described above in connection with FIG. 1, the supply pressure in port 76 displaces diaphragm 82 from valve seat 78 the amount necessary for air flow through orifice 86 and delivery port 88 to exhaust system 12 to be proportional to the exhaust flow through exhaust system 12 and for the excess air flow from pump 18 to be discharged through excess air port 80. A fitting 90 directs the excess air flow from port 80 to a region of substantially atmospheric pressure in the engine air cleaner 92.

A pressure relief valve member 94 is mounted on a pin 96 and is biased by a spring 98 to engage a valve seat 100. When the pressure in inlet plenum 42 rises above a selected value, valve member 94 slides rightwardly on pin 96 against the bias of spring 98 to vent a portion of the air from inlet plenum 42 through fitting 90 to air cleaner 92.

The embodiments of the invention in which an exclusive property or privilege is claimed are defined as follows:

1. In combination with an engine having an exhaust system directing exhaust flow from the engine and an air pump directing air to said exhaust system, a valve controlling the rate of air flow from said pump to said exhaust system, said valve comprising a housing having a supply port connected to said pump and receiving a supply air flow from said pump at a supply pressure, a delivery port connected to said exhaust system and delivering an exhaust air flow to said exhaust system at a delivery pressure substantially equal to the pressure in said exhaust system, an excess air port discharging an air flow at substantially atmospheric pressure, and a valve seat surrounding said supply port and separating said supply port from said excess air port, and a diaphragm secured in said housing and separating said delivery port from said supply port and said valve seat and said excess air port, said diaphragm having an orofice directing said exhaust air flow from said supply port to said delivery port and one face of said diaphragm having a valve surface surrounding said orifice and associated with said valve seat, whereby the supply pressure in said supply port acts against the portion of said diaphragm face surrounded by said valve surface in opposition to the delivery pressure in said delivery port acting against the opposite face of said diaphragm and displaces said diaphragm from said valve seat the amount necessary for the rate of said exhaust air flow to be proportional to the rate of exhaust flow through said exhaust system and for the remainder of said supply air flow to be discharged through said excess air port.

* * * * *